US008002289B2

(12) United States Patent
Diaz

(10) Patent No.: US 8,002,289 B2
(45) Date of Patent: Aug. 23, 2011

(54) ROLLER STOPPER

(76) Inventor: Alberto Diaz, Saint Paul, MN (US)

( * ) Notice: Subject to any disclaimer, the term of this patent is extended or adjusted under 35 U.S.C. 154(b) by 465 days.

(21) Appl. No.: 12/284,539

(22) Filed: Sep. 23, 2008

(65) Prior Publication Data

US 2009/0085314 A1 Apr. 2, 2009

Related U.S. Application Data

(60) Provisional application No. 60/995,869, filed on Sep. 28, 2007.

(51) Int. Cl.
*B25H 5/00* (2006.01)

(52) U.S. Cl. ..... 280/32.6; 188/5

(58) Field of Classification Search ..... 280/32.6, 280/32.5, 79.11; 188/5–8; 254/418, 422
See application file for complete search history.

(56) References Cited

U.S. PATENT DOCUMENTS

| | | | | | |
|---|---|---|---|---|---|
| 2,780,472 | A * | 2/1957 | Weldon, Sr. | ..... | 280/32.6 |
| 2,942,693 | A * | 6/1960 | Johnson | ..... | 188/5 |
| 3,361,437 | A * | 1/1968 | Loftis | ..... | 280/32.6 |
| 4,815,569 | A * | 3/1989 | Norman | ..... | 188/5 |
| 5,035,445 | A * | 7/1991 | Poulin | ..... | 280/763.1 |
| 5,472,219 | A * | 12/1995 | Eckstrum | ..... | 280/32.6 |
| 5,730,449 | A * | 3/1998 | Miles | ..... | 280/32.6 |
| 6,076,838 | A * | 6/2000 | Peterson et al. | ..... | 280/32.6 |
| 6,095,532 | A * | 8/2000 | Martin | ..... | 280/32.6 |
| 2005/0161894 | A1 * | 7/2005 | Lensing | ..... | 280/32.6 |
| 2007/0013154 | A1 * | 1/2007 | Staples | ..... | 280/32.6 |
| 2007/0080510 | A1 * | 4/2007 | Ji | ..... | 280/32.6 |

* cited by examiner

*Primary Examiner* — Kevin Hurley
*Assistant Examiner* — Tashiana Adams
(74) *Attorney, Agent, or Firm* — Jacobson and Johnson; Thomas N. Phung

(57) ABSTRACT

A mechanic's creeper comprising a one-piece creeper frame; a first set of free-rolling wheels located proximal a first side of the creeper frame; a second set of free-rolling wheels located proximal a second side of the creeper frame; a first rotatable shaft attached to the first and second sides of the creeper frame and supporting at least one stopper thereon; a second rotatable shaft attached to the first and second sides of the creeper frame and spaced from the first shaft and supporting at least one stopper thereon, the shafts each rotatable between a stopper up condition and a stopper floor-engaging condition; a linking bar connecting the first and second shaft and providing the shafts with corresponding movement; and an actuating lever connected to an end of the first shaft and moving the shafts between the stopper up condition and stopper floor-engaging condition through a one-step process.

16 Claims, 3 Drawing Sheets

ROLLER STOPPER

CROSS REFERENCE TO RELATED APPLICATIONS

This application claims priority to currently pending U.S. Provisional Application Ser. No. 60/995,869; filed on Sep. 28, 2007; titled ROLL STOPPER.

FIELD OF THE INVENTION

This invention relates generally to automobile repair devices and more specifically to an improved mechanic's creeper having a stopping mechanism to prevent movement of the creeper from a desired location.

STATEMENT REGARDING FEDERALLY SPONSORED RESEARCH OR DEVELOPMENT

None

REFERENCE TO A MICROFICHE APPENDIX

None

BACKGROUND OF THE INVENTION

Mechanic's creepers are widely used in the automotive repair industry to assist mechanics in the maintenance and repair of vehicles. Creepers allow their user free-rolling access to various regions underneath the vehicle. However, one of the main problem commonly associated with mechanic's creepers is that due to their rollability, mechanic's creepers have a tendency to roll or shift out of a desired position while the user is supported thereon and performing maintenance or repair on the vehicle, which can lead to not only efficiency but also safety issues. In addition, since the user usually has tools in hand when the user is on the creeper and underneath the vehicle, the user is limited in the his or her ability to control movement of the creeper.

Although locking devices for individual free-rolling wheels have been used for devices such as rollable carts and rollable cabinets, use of those locking devices are not practical for creepers, especially when the user is on the creeper and underneath the vehicle as the user would be required to separately lock each of the wheels to prevent the creeper from rolling out of a desired location in a confining space. There thus is a need for a mechanism to allow the user of mechanic's creepers free-rolling access to various regions underneath the vehicle while also allowing the user to maintain the mechanic's creeper in a fixed chosen location during the user's maintenance or repair of the vehicle through a one-step process.

SUMMARY OF THE INVENTION

The present invention is a mechanic's creeper comprising a one-piece creeper frame having a first side, a second side, a first end, and a second end. Located proximal the first side of the creeper frame is a first set of free-rolling wheels that are positioned in a space condition from each other. Located proximal the second side of the creeper frame is a second set of free-rolling wheels that are also positioned in a space condition from each other. The mechanic's creeper includes a first rotatable shaft and a second rotatable shaft attached to the first side and second side of the creeper frame with the shafts each supporting a set of stoppers thereon. The first rotatable shaft and the second rotatable shaft are each rotatable between a stopper up condition to allow free movement of the creeper frame and a stopper floor-engaging condition to maintain the creeper frame in a fixed position.

The mechanic's creeper further includes a linking bar connecting the first shaft to the second shaft and providing the first shaft and second shaft with corresponding movement. Connected to an end of the first shaft is an actuating lever that functions to move the first shaft and in turn the second shaft between the stopper up condition and stopper floor-engaging condition. The mechanic's creeper also includes lever-supporting member located on the creeper frame for lockingly maintaining the actuating lever therein to secure the first shaft and second shaft in the stopper floor-engaging condition.

DESCRIPTION OF THE PREFERRED EMBODIMENT

Figure 1:
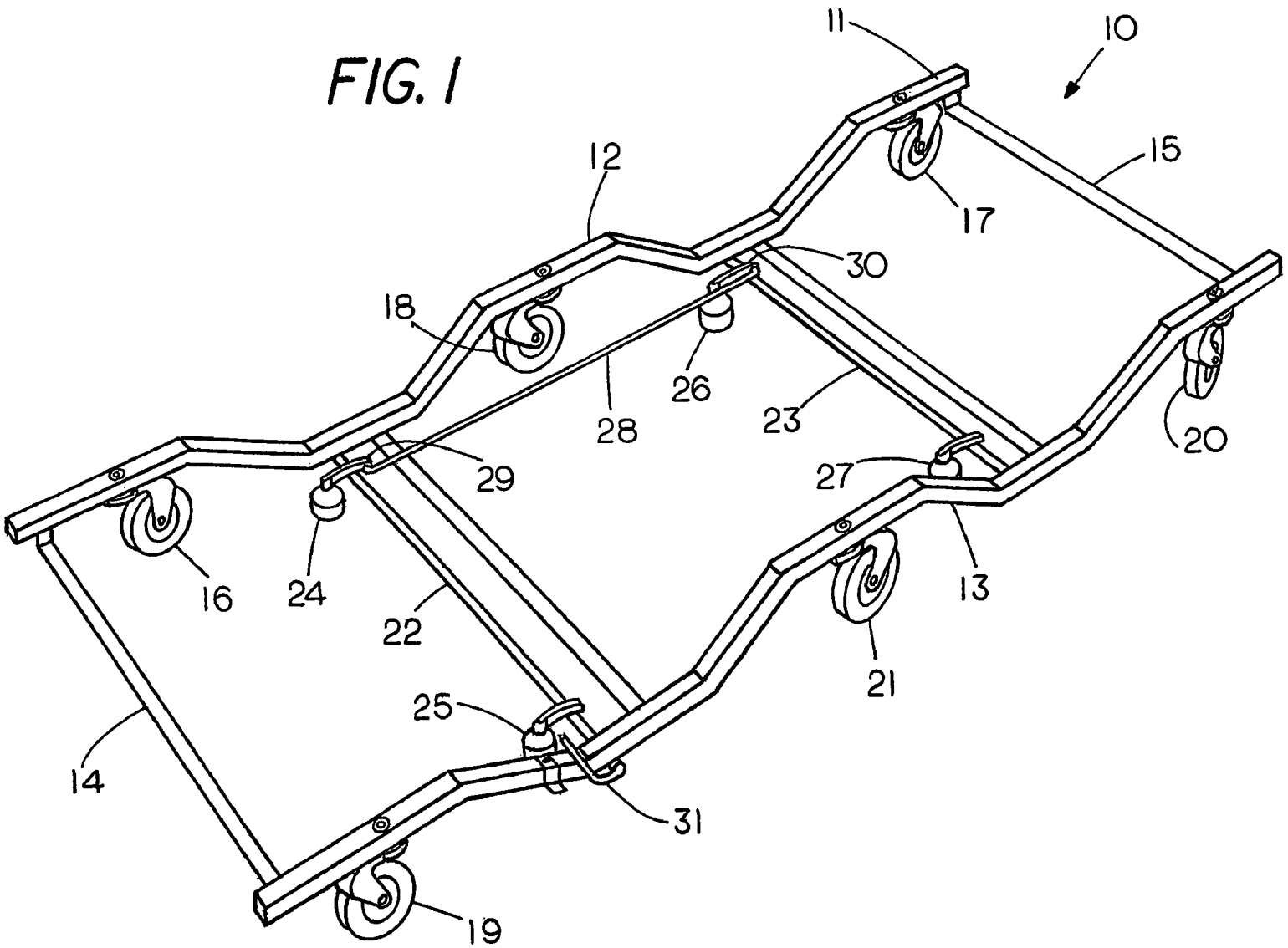
FIG. 1 is a perspective view showing a mechanic's creeper having a stopping mechanism to prevent movement of the creeper from a desired location.
Figure 2:
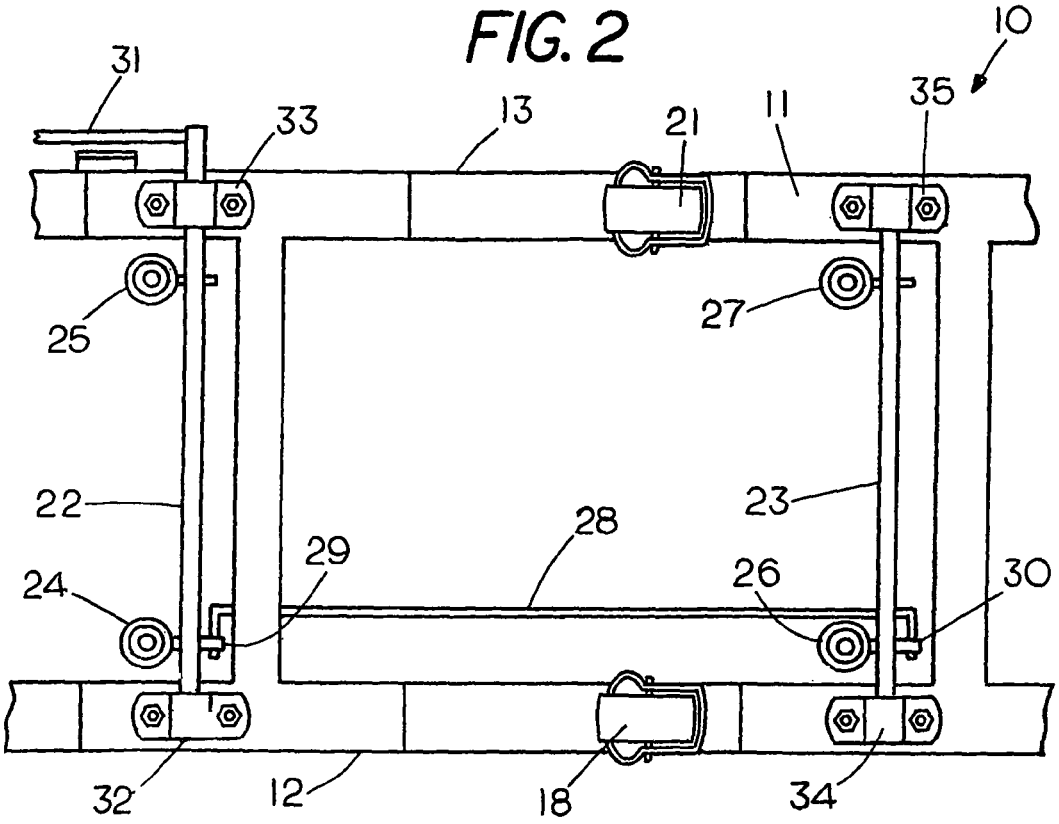
FIG. 2 shows a partial bottom view of the mechanic's creeper of FIG. 1.

Referring to FIGS. 1 and 2, FIG. 1 is a perspective view showing an embodiment of a mechanic's creeper 10 having a stopping mechanism to prevent movement of the creeper from a desired location. FIG. 2 shows a partial bottom view of the mechanic's creeper 10 of FIG. 1. As shown in FIGS. 1 and 2, mechanic's creeper 10 generally comprises a one-piece creeper frame 11 having a first side 12, a second side 13, a first end 14, and a second end 15. Although alternative embodiments of mechanic's creeper 10 may include different number of wheels located on different regions of the one-piece creeper frame 11, mechanic's creeper 10 is shown in FIG. 1 as having a first free-rolling wheel 16 located on first side 12 of creeper frame 11 proximal first end 14, a second free-rolling wheel 17 located on first side 12 proximal second end 15 and a third free-rolling wheel 18 located on first side 12 and spaced between first free-rolling wheel 16 and second free-rolling wheel 17. Although not shown, the mechanic's creeper of the present invention may include a user support member such as but not limited to a platform comprising a board, a cushion, or both located on the creeper frame for supporting the user thereon.

Similar to the first side 12 of creeper frame 11, mechanic's creeper 10 is shown in FIG. 1 as also having a fourth free-rolling wheel 19 located on second side 13 of creeper frame 11 proximal first end 14, a fifth free-rolling wheel 20 located on second side 13 proximal second end 15 and a sixth free-rolling wheel 21 located on second side 13 and spaced between fourth free-rolling wheel 20 and fifth free-rolling wheel 21.

invention is that the mechanic's creeper includes a stopping mechanism to prevent movement of the creeper from a desired location. The embodiment of FIGS. 1 and 2 shows the stopping mechanism as comprising a first shaft 22 and a second shaft 23 attached to the first side 12 and second side 13 of the creeper frame 11. Although first shaft 22 and second shaft 23 may be attached to the first side 12 and second side 23 of the creeper frame 11 by a variety of means, FIG. 2 shows first shaft 22 secured to the first side 12 and second side 13 of the creeper frame 11 by a first set of mounting brackets 32 and 33 and second shaft 23 secured to the first side 12 and second side 13 of the creeper frame 11 by a second set of mounting brackets 34 and 35. A feature of the present First shaft 22 is shown supporting a first stopper 24 and a second stopper 25 in a spaced conditioned thereon and second shaft 23 is shown supporting a third stopper 26 and a second stopper 27 in a spaced conditioned thereon. A feature of the present invention is that the first shaft 22 and the second shaft 23 each are rotatable between a stopper up condition, which allows for the free movement of the creeper frame 11 on a support surface such as a floor or the ground and a stopper floor-engaging condition to maintain the creeper frame 11 and in turn mechanic's creeper 10 in a fixed desired location.

The stopping mechanism of mechanic's creeper 10 also includes a linking bar 28 connecting the first shaft 22 to the second shaft 23 to provide the first shaft 22 and second shaft 23 with corresponding movement. That is, the rotation of first shaft 22 from the stopper up condition to the stopper floor-engaging condition will lead or initiate linking bar 28 to act on second shaft 23 to also rotate second shaft 23 from the stopper up condition to the stopper floor-engaging condition. Likewise, the rotation of first shaft 22 from the stopper floor-engaging condition to the stopper up condition will lead to linking bar 28 to act on second shaft 23 to also rotate second shaft 23 from the stopper floor-engaging condition to the stopper up condition.

Although linking bar 28 may be connected to the first shaft 22 and second shaft 23 by a plurality of means, in the embodiment of FIG. 1, mechanic's creeper 10 is shown including a first attachment member 29 connecting linking bar 28 to first shaft 22 and a second attachment member 30 connecting linking bar 28 to second shaft 23.

Although linking bar 28 may be connected to the first shaft 22 and second shaft 23 by a plurality of means, in the embodiment of FIG. 1, mechanic's creeper 10 is shown including a first attachment member 29 connecting linking bar 28 to first shaft 22 and a second attachment member 30 connecting linking bar 28 to second shaft 23. The attachment member 29 is also shown securing first stopper 24 to the first shaft 22 and the attachment 30 is shown securing stopper 26 to the second shaft 23 with the attachment members 29 and 30 both shown located between the first side 12 and the second side 13 of the one-piece creeper frame 11.

The stopping mechanism of mechanic's creeper 10 further includes an actuating lever 31 connected to an end of the first shaft 22 for displacing the first shaft 22 and in turn the second shaft 23 between the stopper up condition and stopper floor-engaging condition. Since actuating lever 31 controls the movement of both the first shaft 22 and the second shaft 23, actuating lever 31 allows the user the ability to move mechanic's creeper 10 between the stopper up condition and stopper floor-engaging condition through a quick one-step process.

Figure 3:
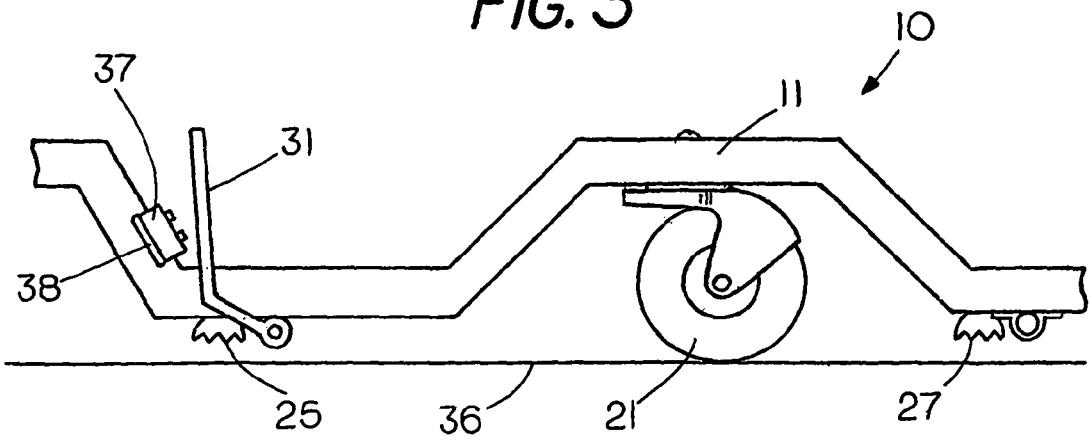
FIG. 3 shows a partial side view of the mechanic's creeper of FIG. 1 in a normal rollable condition.
Figure 4:
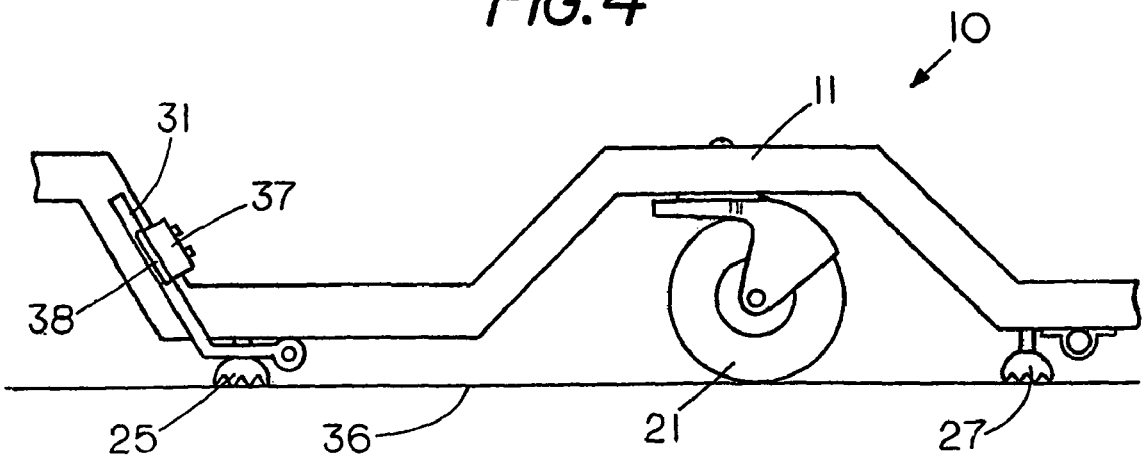
FIG. 4 shows a partial side view of the mechanic's creeper of FIG. 1 in a non-moving condition.

Referring to FIGS. 3 and 4, FIG. 3 shows a partial side view of the mechanic's creeper 10 of FIG. 1 in a stopper up condition to allow for the normal free-rolling movement of the creeper frame 11. FIG. 4 shows a partial side view of the mechanic's creeper 10 of FIG. 1 in a stopper floor-engaging condition to prevent undesired movement of creeper frame 11 and maintain creeper frame 11 in a fixed position. As shown in FIG. 3, when mechanic's creeper 10 is in the stopper up condition, stoppers 24, 25, 26, and 27 are spaced or raised from a support surface 36 such that creeper frame 11 is supported on support surface 36 solely by free-rolling wheels 16, 17, 18, 19, 20, and 21. In the stopper up condition the creeper frame 11 is permitted to normally roll in almost a 360° direction while supporting the user thereon as there is little to no resistance to hinder the movement of wheels 16, 17, 18, 19, 20, and 21. As also shown in the embodiment of FIG. 3, when mechanic's creeper 10 is in the stopper up condition, the actuating lever 31 is positioned upwards and away from a lever support member 37.

Referring to FIG. 4, when mechanic's creeper 10 is in the stopper floor-engaging condition, stoppers 24, 25, 26, and 27 engages support surface 36 to assist rolling wheels 16, 17, 18, 19, 20, and 21 to supporting creeper frame 11 on support surface 36. The engagement of stoppers 24, 25, 26, and 27 to support surface 36 creates a frictional resistance to hinder movement of creeper frame 11 via wheels 16, 17, 18, 19,20, and 21. When mechanic's creeper 10 is in the stopper floor-engaging condition, actuating lever 31 is positioned almost parallel to lever support member 37. In order to maintain mechanic's creeper 10 in the stopper floor-engaging condition, a portion of actuating lever 31 may be engageably secured to a curved or slotted leg 38 extending from lever support member 37 to prevent the rotation of the first and second shaft 22 and 23 and the displacement of stoppers 24, 25, 26, and 27.

Figure 5:
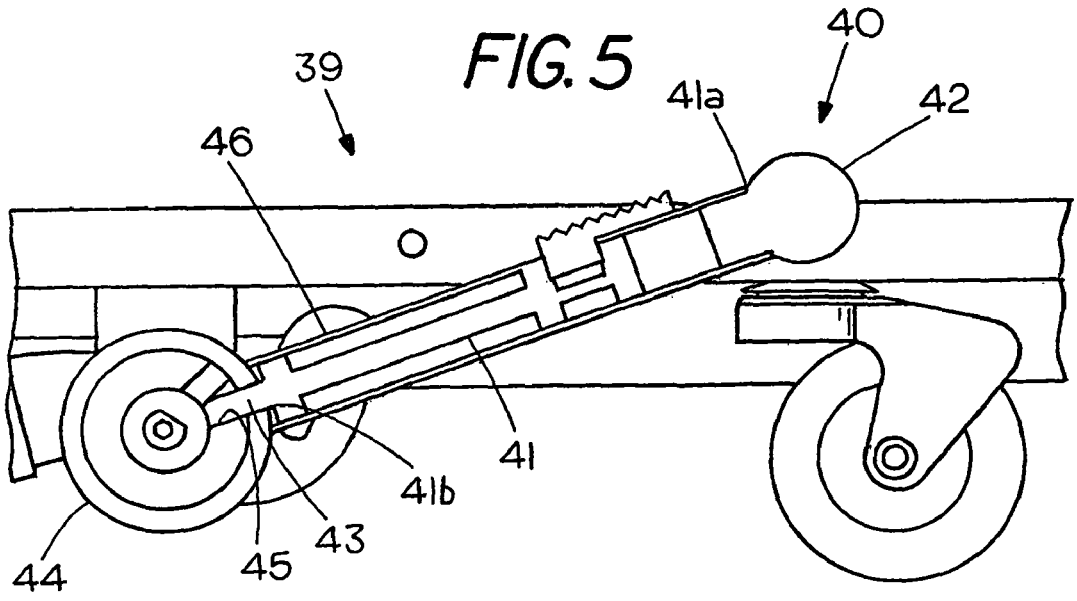
FIG. 5 is a partial side view showing an alternative embodiment of a stopping mechanism.

FIG. 5 is a partial side view showing an alternative embodiment of a stopping mechanism having similar components to the stopping mechanism of mechanic's creeper 10. However, in the embodiment of FIG. 5 actuating lever 31 is replaced with an actuating lever 40 for moving a mechanic's creeper 39 of the present invention between the stopper up condition and stopper floor-engaging condition. Actuating lever 40 is shown located on a side of mechanic's creeper 39 proximal a wheel 44. Actuating lever 40 comprises a housing 46 supporting a shaft 41 having a first end 41*a* and a second 41*b* therein. Located at the first end 41*a* of shaft 41 is a grasping handle 42 and extending from the second end 41*b* of shaft 41 is a locking pin 43.

In the embodiment of FIG. 5, mechanic's creeper 39 is shown in a stopper floor-engaging condition. Unlike mechanic's creeper 10, which uses the engagement between actuating lever 31 and curved or slotted leg 38 to maintain mechanic's creeper 10 in the stopper floor-engaging condition, mechanic's creeper 39 uses the engagement between the locking pin 43 of shaft 41 and a slot 45 located on wheel 44 to help maintain mechanic's creeper 10 in the stopper floor-engaging condition. The engagement between the locking pin 43 of shaft 41 and slot 45 functions to maintain mechanic's creeper 10 in the stopper floor-engaging condition by locking the shaft 41 to prevent the rotation of the first and second shaft (not shown) and the displacement of stoppers (not shown). In addition the engagement between the locking pin 43 of shaft 41 and slot 45 of wheel 44 also locks wheel 44 from rotating to hinder movement of mechanic's creeper 39. Although wheel 44 is shown in FIG. 5 as having two slots for receiving the locking pin 43, alternative embodiments of the present invention may include mechanic's creeper having wheel with as few as one slot to a plurality of slots for receiving the locking pin of the shaft.

To move mechanic's creeper 39 from the stopper floor-engaging or creeper-lock condition to the stopper up or free-moving condition, the user first grabs onto handle 42 and exert a pulling force to shaft 41 to remove locking pin 43 from slot 45. The user then displaces actuating lever 40 to initiate the rotation of the first shaft and second shaft of mechanic's creeper 39 (not shown) from the stopper floor-engaging condition to the stopper up condition to allow mechanic's creeper 39 to move freely thereabout. Vice verse, to move mechanic's creeper 39 from the stopper up or free-moving condition to the stopper floor-engaging or creeper-lock condition, the user first displaces actuating lever 40 to initiate the rotation of the first shaft and second shaft of mechanic's creeper 39 from the stopper up condition to the stopper floor-engaging condition. The user then exert a force to shaft 41 to pushing shaft 41 towards wheel 44 until locking pin 43 engage slot 45 on wheel 44 to maintain mechanic's creeper 39 at a desired location.

I claim:

1. A mechanic's creeper comprising:

a one-piece creeper frame having a first side, a second side, a first end, and a second end;

a first set of free-rolling wheels located proximal the first side of the creeper frame, the wheels positioned in a spaced condition from each other;

a second set of free-rolling wheels located proximal the second side of the creeper frame, the wheels positioned in a spaced condition from each other;

a first rotatable shaft attached to the first side and the second side of the creeper frame, the first shaft supporting at least one stopper thereon;

a second rotatable shaft attached to the first side and the second side of the creeper frame, the second shaft located in a spaced condition from the first shaft and supporting at least one stopper thereon, the first shaft and the second shaft each rotatable between a stopper up condition to allow free movement of the creeper frame and a stopper floor-engaging condition to maintain the creeper frame in a fixed location;

a linking bar connecting the first shaft to the second shaft and providing the first shaft and second shaft with corresponding movement; and an actuating lever connected to an end of the first shaft and located proximal one of the free-rolling wheels, the actuating lever moving the first shaft and the second shaft between the stopper up condition and stopper floor-engaging condition through a one-step process, the actuating lever comprising a housing supporting a shaft having a first end and a second end therein, the first end of the shaft includes a grasping handle and the second end of the shaft includes a locking pin mateable with a slot located on one of the free-rolling wheels to secure the first shaft and second shaft in the stopper floor-engaging condition.

2. The mechanic's creeper of claim 1 wherein the first rotatable shaft supports at least two spaced stopper thereon and the second rotatable shaft supports at least two spaced stopper thereon.

3. The mechanic's creeper of claim 1 including a lever supporting member lockingly maintaining the actuating lever therein to secure the first shaft and second shaft in the stopper floor-engaging condition.

4. The mechanic's creeper of claim 1 wherein one of the free-rolling wheels includes a plurality of slots for receiving the locking pin of the shaft.

5. The mechanic's creeper of claim 1 including a first attachment member securing one of the stoppers to the first shaft and a second attachment member securing one of the stoppers to the second shaft, the first attachment member and the second attachment member located between the first side and the second side of the one-piece creeper frame and connecting the linking bar to the first shaft and the second shaft.

6. The mechanic's creeper of claim 1 wherein the first set of free-rolling wheels located proximal the first side of the creeper frame comprises three free-rolling wheels and the second set of free-rolling wheels located proximal the second side of the creeper frame comprises three free-rolling wheels.

7. The mechanic's creeper of claim 1 including a first set of mounting brackets for securing the first rotatable shaft to the first side and second side of the creeper frame and a second set of mounting brackets for securing the second rotatable shaft to the first side and second side of the creeper frame.

8. A mechanic's creeper comprising:

a one-piece creeper frame having a first side, a second side, a first end, and a second end;

a first set of free-rolling wheels located proximal the first side of the creeper frame, the wheels positioned in a spaced condition from each other;

a second set of free-rolling wheels located proximal the second side of the creeper frame, the wheels positioned in a spaced condition from each other;

a first rotatable shaft attached to the first side and second side of the creeper frame, the first rotatable shaft supporting a set of spaced stoppers thereon;

a second rotatable shaft attached to the first side and second side of the creeper frame, the second rotatable shaft spaced from the first rotatable shaft, the second rotatable shaft supporting a set of spaced stoppers thereon, the first shaft and the second shaft each rotatable between a stopper up condition to allow free movement of the creeper frame and a stopper floor-engaging condition to maintain the creeper frame in a fixed position;

a linking bar connecting the first shaft to the second shaft and providing the first shaft and second shaft with corresponding movement;

a first attachment member securing one of the stoppers to the first shaft and a second attachment member securing one of the stoppers to the second shaft, the first attachment member and the second attachment member located between the first side and the second side of the one-piece creeper frame and connecting the linking bar to the first shaft and the second shaft; and an actuating lever connected to an end of the first shaft, the actuating lever moving the first shaft and the second shaft between the stopper up condition and stopper floor-engaging condition through a one-step process.

9. The mechanic's creeper of claim 8 including a lever supporting member lockingly maintaining the actuating lever therein to secure the first shaft and second shaft in the stopper floor-engaging condition.

10. The mechanic's creeper of claim 8 wherein the actuating lever is located proximal one of the free-rolling wheels and comprises a housing supporting a shaft having a first end and a second therein, the first of the shaft includes a grasping handle and the second end of the shaft includes a locking pin mateable with a slot located on one of the free-rolling wheels to secure the first shaft and second shaft in the stopper floor-engaging condition.

11. The mechanic's creeper of claim 10 wherein one of the free-rolling wheels includes a plurality of slots for receiving the locking pin of the shaft.

12. The mechanic's creeper of claim 8 wherein the first set of free-rolling wheels located proximal the first side of the one-piece creeper frame comprises three free-rolling wheels and the second set of free-rolling wheels located proximal the second side of the one-piece creeper frame comprises three free-rolling wheels.

13. The mechanic's creeper of claim 8 including a first set of mounting brackets for securing the first rotatable shaft to the first side and second side of the one-piece creeper frame and a second set of mounting brackets for securing the second rotatable shaft to the first side and second side of the one-piece creeper frame.

14. A mechanic's creeper comprising:

a one-piece creeper frame having a first side, a second side, a first end, and a second end;

a first set of free-rolling wheels located proximal the first side of the creeper frame, the wheels positioned in a spaced condition from each other;

a second set of free-rolling wheels located proximal the second side of the creeper frame, the wheels positioned in a spaced condition from each other;

a first rotatable shaft attached to the first side and second side of the creeper frame, the first rotatable shaft supporting a set of spaced stoppers thereon;

a second rotatable shaft attached to the first side and second side of the creeper frame, the second rotatable shaft spaced from the first rotatable shaft, the second rotatable shaft supporting a set of spaced stoppers thereon, the first shaft and the second shaft each rotatable between a stopper up condition to allow free movement of the creeper frame and a stopper floor-engaging condition to maintain the creeper frame in a fixed position;

a linking bar connecting the first shaft to the second shaft and providing the first shaft and second shaft with corresponding movement;

a first attachment member securing one of the stoppers to the first shaft and a second attachment member securing one of the stoppers to the second shaft, the first attachment member and the second attachment member located between the first side and the second side of the one-piece creeper frame and connecting the linking bar to the first shaft and the second shaft; and an actuating lever located proximal one of the free-rolling wheels and connected to an end of the first shaft to move the first shaft and the second shaft between the stopper up condition and stopper floor-engaging condition through a one-step process, the actuating lever comprising a housing supporting a shaft having a first end and a second therein, the first of the shaft includes a grasping handle and the second end of the shaft includes a locking pin mateable with a slot located on one of the free-rolling wheels to secure the first shaft and second shaft in the stopper floor-engaging condition.

15. The mechanic's creeper of claim 14 wherein one of the free-rolling wheels includes a plurality of slots for receiving the locking pin of the shaft.

16. The mechanic's creeper of claim 14 including a first set of mounting brackets for securing the first rotatable shaft to the first side and second side of the one-piece creeper frame and a second set of mounting brackets for securing the second rotatable shaft to the first side and second side of the one-piece creeper frame.

* * * * *